United States Patent [19]

Danielson et al.

[11] Patent Number: 4,524,880

[45] Date of Patent: Jun. 25, 1985

[54] CLOSURE DEVICE

[75] Inventors: Carl O. Danielson, Upsala; Bo B. Gustafsson, Alunda; Göte E. Richardsson; Karl-Erik Lundh, both of Gislaved, all of Sweden

[73] Assignee: Pharmacia AB, Upsala, Sweden

[21] Appl. No.: 628,591

[22] Filed: Jul. 6, 1984

[30] Foreign Application Priority Data

Jul. 29, 1983 [SE] Sweden ..... 8304207

[51] Int. Cl.[3] ..... A61J 1/00

[52] U.S. Cl. ..... 220/288; 604/415; 222/83

[58] Field of Search ..... 220/288, 277, 278; 222/83, 83.5, 88; 215/DIG. 3; 604/415

[56] References Cited

U.S. PATENT DOCUMENTS

| | | | |
|---|---|---|---|
| 3,149,755 | 9/1964 | Porter et al. | 222/83 |
| 3,664,338 | 5/1972 | Knox et al. | 604/415 |
| 3,978,859 | 9/1976 | Goodenough et al. | 604/415 |
| 3,986,508 | 10/1976 | Barrington | 222/83 X |
| 4,331,147 | 5/1982 | Armstrong | 604/415 X |
| 4,445,896 | 5/1984 | Gianturco | 604/415 X |

*Primary Examiner*—Steven M. Pollard

*Attorney, Agent, or Firm*—Birch, Stewart, Kolasch & Birch

[57] ABSTRACT

A closure device for fluid-tight closure of an opening of a fluid container. The device comprises a casing part (1) and a cap part (2). These parts are injection molded from different plastic materials, preferably from PVC and polypropylene, respectively, one partially against the other. A tubular portion (12) of the cap part (2) intrudes sealingly into a substantially cylindrical hollow space between an internal and an external sleeve portion (3,4) of the casing part (1).

9 Claims, 2 Drawing Figures

CLOSURE DEVICE

SUMMARY OF THE INVENTION

Field of the Invention

The invention relates to a closure device for fluid-tight, especially sterile closure of an opening of a fluid container or a fluid conduit, comprising a casing part for permanent connection to said opening, and a cap part, which is detachably connectable to said casing part.

Description of Background Art

Such closure devices are used in a number of different applications, e.g. for the storage of foodstuffs and pharmaceuticals and in medical technology. In such cases it is often essential that the fluid pathway of the closure can be kept sterile. A particular field, where a sterile closure is of prime importance, is dialysis according to the so called CAPD (Continous Ambulatory Peritoneal Dialysis) method, wherein a dialysis solution is available in disposable plastic bags, each such bag being connected, about four times a day, via a permanent catheter directly to the patient's abdomen.

SUMMARY AND OBJECTS OF THE INVENTION

The main object of the invention is to provide a closure device of this kind which ensures an effective fluid seal between the casing part and the cap part and makes special sterilization measures unnecessary upon removal of the cap part from the casing part. Furthermore, the device should be simple and easy to manufacture.

These objects are accomplished as disclosed in the international patent application No. PCT/US83/00355 (WO83/03572 published after the priority date of the present application), wherein the casing and cap parts are molded in the same mold, one partially against the other, from different thermoplastic materials having different melting points so as to permit relative movement of the mutually contacting surfa thereof. First, the part having the highest melting point is injection molded and then, directly following the solidification thereof, the other part is injection molded in the same mold while letting the first, solidified part constitute a portion of the mold. The relatively high temperature during the injection molding in combination with the fact that the mutually contacting surface portions of the two parts are not freely exposed thereafter will ensure that these surface portions are kept sterile. The difference between the melting points should be significant, namely at least 20° C. and preferably more, so that the material of the part molded first will not soften and adhere to the other part. In fact, as little adherence as possible should be attained, which can be realized by a suitable combination of materials. Minimal adherence and low relative friction can be obtained if one material is relatively hard and has a "fatty" surface, whereas the other material is somewhat softer and thus yields a little, when the two parts are moved relative to each other. It has turned out that polyolefins, such as polypropylene or polymethylpentene (TPX), and polyvinylchloride, constitute such a material combination. Polypropylene has a higher melting point (about 155°-160° C.) and is somewhat harder and has a "fatty" surface, while polyvinylchloride (hardness about 65 to 98, preferably 85-90 Shore) has a lower melting point (about 140° C.), is a little softer and has a very low surface friction against polypropylene.

The combination polypropylene—PVC has been proposed previously in other fields of technology, e.g. in DE-A No. 2,603,393, though with a softer PVC quality, wherein a chemical connection between the two materials was aimed at and obtained by injection molding in two steps (in producing a pipe connection sleeve and a sealing ring connected thereto). In contrast, according to the present invention, the two parts are movable relative to each other, although they have mutually contacting surface portions providing an effective seal.

Upon molding the first part, e.g. the cap part, the other part, e.g. the casing part, is injection molded with the first part forming a portion of the mold. Thus, the first part does not have to be removed separately and will not be contaminated by impurities or micro-organisms, since the fluid-tightly sealing surface portions thereof will never be freely exposed or touched but are protectively covered by the other part directly upon the solidification of the material.

Moreover, according to the novel features of the invention, the geometry of the two parts is such that the mutually contacting surface portions secure an effective sealing while permitting the parts to be detached from each other. More particularly, the casing part comprises an internal sleeve portion, which communicates with the opening of the fluid container or fluid conduit, and an external sleeve portion, which surrounds the internal sleeve portion at a distance so as to form a substantially cylindrical hollow space therebetween. The cap part, on the other hand, comprises a tubular portion dimensioned to sealingly intrude into said substantially cylindrical hollow space. Furthermore, coupling means, such as helical screw threads, or snap means, e.g. teeth or hook members, are provided for establishing a releasable mechanical coupling between the tubular portion of the cap part and at least one of the internal and external sleeve portions of the casing part.

By providing a tubular portion intruding into the hollow space between the internal and external sleeves of the casing part, sterile conditions in the fluid pathway can easily be maintained, in particular because of the relatively long leakage path between the inside of the internal sleeve portion and the outside of the external sleeve portion. Also, these mutually contacting surface portions have double functions, namely to provide a sterile seal as well as a releasable coupling between the two parts. The length of the leakage path will be increased and the effective sealing will be further improved when using a helical screw thread as a coupling means.

BRIEF DESCRIPTION OF THE DRAWINGS

Further features of the invention are defined in the subclaims and will be apparent from the detailed description below of a preferred embodiment of the invention, reference being made to the appended drawings.

DETAILED DESCRIPTION OF THE INVENTION

Figure 1:
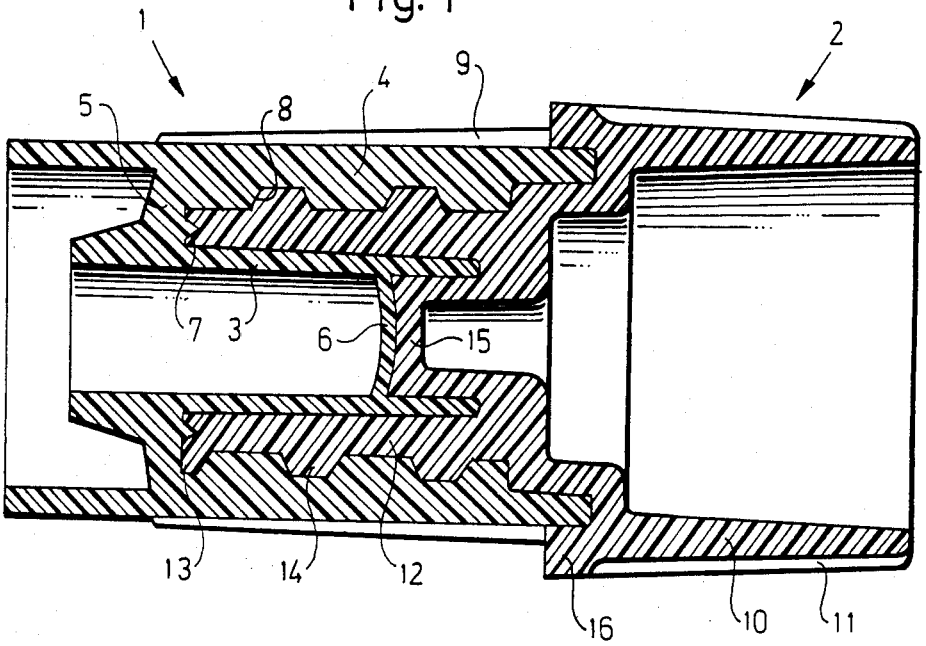
FIG. 1 shows an axial section through the casing and cap parts of the closure device, the two parts being coupled to each other.

In FIG. 1, the casing part 1 of the closure device is shown to the left, and the cap part 2 thereof to the right.

These parts have been formed by injection molding, as described above, and the casing part 1 consists of PVC, whereas the cap part 2 consists of polypropylene.

The casing part 1, which is to be permanently connected to a container or a hose, in the present example on a disposable bag for a dialysis solution, comprises essentially an internal sleeve 3 and an external sleeve 4, which are joined to each other by means of a radial connection portion 5. The internal sleeve 3, at some distance from its free end, is provided with a diaphragm 6 (to be penetrated by an injection device according to FIG. 2) unitarily formed therewith, but is otherwise substantially smooth. The radial connection portion 5 has a sealing flange 7 facing the cap part 2 and being formed as an annular ridge having a rather sharp free edge. The outer sleeve 4 has a larger wall thickness than the internal sleeve and is provided with an internal thread groove 8 along the major part of its length. The external cylindrical surface of the external sleeve 4 is provided with longitudinal ribs 9 distributed circumferentially and facilitating the handling thereof when screwing the cap part 2 into or out of the casing part.

The cap part 2 consists essentially of a sleeve-like grip portion 10, which is provided with external ribs 11 (similar to the ribs 9 of the casing part 1), and a tubular portion 12 connected thereto and having a smaller diameter than the grip portion so as to extend complementarily into the hollow space between the internal and external sleeves 3 and 4, respectively, of the casing part 1. The external mantle surface of the tubular portion 12 is somewhat conical so as to taper with a small cone angle (half top angle) of about one degree towards the free end 13. A trapezoidal thread 14 engages the thread groove 8 of the casing part and extends helically along the major part of the tubular portion up to the end 13. The crest of the thread has approximately the same cone angle as the mantle surface, whereas the width of the trapezoidal thread profile decreases somewhat towards the end 13. In this way, an efficient threaded engagement is ensured while facilitating an easy screwing of the cap part into and out of the casing part. The cap part 2 has also a central boss 15, which forms a mold surface for the diaphragm when injection molding the same, and an annular flange 16 forming an extension of the grip portion 10 and contacting the free end of the external sleeve 4 from the outside. Possibly, this free end can be somewhat widened in its outer portion, so that a certain snap locking effect is obtained when screwing the cap part 2 into the casing part 1.

Figure 2:
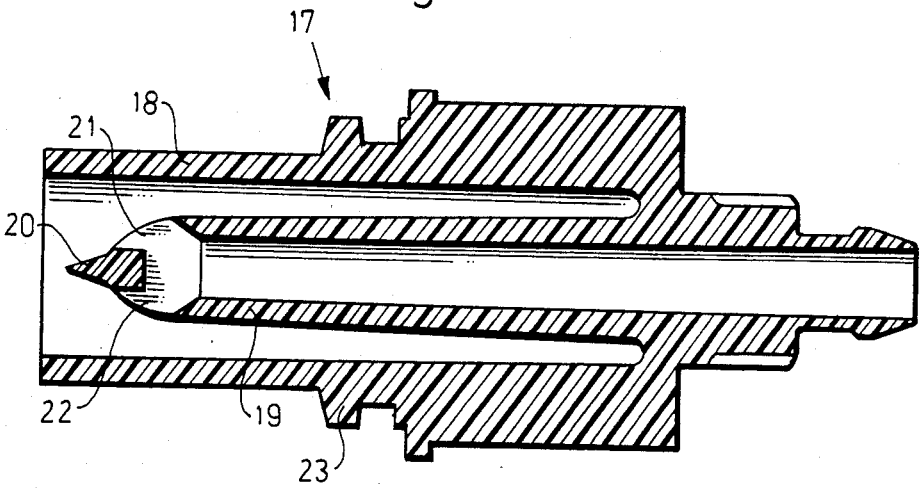
FIG. 2 shows an axial section through an injection member to be coupled to the casing part of FIG. 1.

In the present example the closure device according to FIG. 1 is intended to be connected (with its left end of the drawing) sealingly, e.g. by means of welding, to an opening of a plastic bag (not shown) filled with a dialysis solution. Then, the cap part 2 is situated in its shown position screwed into the casing part, as formed when being injection molded, and is screwed out of the casing part only when the patient is to connect the bag to a hose (not shown), on the end of which the injection device 17 of FIG. 2 is connected.

The injection device 17 has an external sleeve portion 18, which fits into the hollow space between the internal and external sleeves 3 and 4, respectively, of the casing part 1 (FIG. 1) and an injection portion 19, which at its free end tapers into a needle or a pin 20, through openings 21, 22 being formed in the wall of the sleeve-like portion 19 adjacent to the pin 20. When the injection device 17 is inserted into the casing part 1, the pin 20 will penetrate the diaphragm 6, and the injection sleeve-like portion 19 will seal against the inside of the external sleeve 3, so that the radially external portions of the coupling device will never contact the dialysis solution. The risk of contamination is therefore minimal. Furthermore, the injection device 17 comprises a thread 23, whereby it can be effectively held in its inserted, coupled position.

In other applications, a closure device similar to the one in FIG. 1 can be without a diaphragm in the casing part, wherein the necessary seal is obtained by the mutually contacting surfaces of the two parts. The cap part 2 can be screwed off and on several times, e.g. when the casing portion forms the opening of a pouring bottle, wherein it is an advantage that the thread of the cap part 1 (which can easily be contaminated) is situated far away from the pouring opening. In such case, the internal sleeve 3 can preferably extend somewhat passed the external sleeve 4.

Even in other respects, the inventive idea can be used in several ways within the scope of claim 1. The design of the casing and cap parts can of course be modified, and other material combinations than polypropylene—PVC are possible.

We claim:

1. A closure device for fluid-tight closure of an opening of a fluid container or fluid conduit, comprising a casing part (1) for permanent connection to said opening, and a cap part (2) which is detachably connectable to said casing part, characterized in that said casing and cap parts (1,2) are molded in the same mold, one partially against the other, from two different thermoplastic materials having different melting points so as to permit relative movement of the mutually contacting surface portions thereof, and in that said casing part (1) comprises an internal sleeve portion (3), which communicates with said opening, and an external sleeve portion (4), which surrounds the internal sleeve portion (3) at a distance so as to form a substantially cylindrical hollow space therebetween, said cap part (2) comprising a tubular portion (12) dimensioned to sealingly intrude into said substantially cylindrical hollow space, and coupling means (14,8) being provided for establishing a releasable mechanical coupling between said tubular portion (12) and at least one of said internal and external sleeve portions (3,4).

2. A closure device according to claim 1, characterized in that said coupling means comprises helically extending screw thread means (14,8).

3. A closure device according to claim 2, characterized in that said screw thread means consists of an external thread (14) on said tubular portion (12) and an internal thread groove (8) in said external sleeve portion (4).

4. A closure device according to claim 1, characterized in that said tubular portion (12) tapers conically towards its free end (13).

5. A closure device according to claim 1, characterized in that said cap part (2) includes a radially external annular flange (16) which, upon connection of said cap part (2) and said casing part (1), engages tightly with the free end of the external sleeve portion (4) of the casing part (1).

6. A closure device according to claim 1, wherein said casing part (1) comprises a diaphragm (6) to be pierced by a needle (20), characterized in that said cap part (2) comprises a central boss portion (15) which, upon connection of said cap part (2) and said casing part (11), makes contact with said diaphragm (6).

7. A closure device according to claim 6, characterized in that said casing part (1) is dimensioned for alternative connection to an injection device (17) provided with said needle (20) for piercing the diaphragm (6) of the casing part (1).

8. A closure device according to claim 1, characterized in that said internal and external sleeve portions (3,4) are joined by an annular radially extending connection portion (5) forming a bottom surface, which defines the inner end of said hollow space, annular, complementarily shaped means (7) being formed on said bottom surface and on the free end of said tubular portion (12) to provide a further seal between the casing and cap parts (1,2).

9. A closure device according to claim 3, characterized in that said external thread (14) is trapezoidal, the width thereof decreasing towards the free end (13) of said tubular portion (12).

* * * * *